United States Patent [19]

Lomecka

[11] Patent Number: 4,671,601

[45] Date of Patent: Jun. 9, 1987

[54] CONNECTOR FOR INDIVIDUAL CONDUCTORS

[75] Inventor: Chris Lomecka, Grimbergen, Belgium

[73] Assignee: Burndy Corporation, Norwalk, Conn.

[21] Appl. No.: 778,474

[22] Filed: Sep. 20, 1985

[30] Foreign Application Priority Data

Sep. 27, 1984 [BE] Belgium ..... 0/213,733

[51] Int. Cl.[4] ..... H01R 13/506

[52] U.S. Cl. ..... 439/404; 439/600; 439/687

[58] Field of Search ..... 339/206 R, 206 P, 207 R, 339/211, 210 M, 97 P, 97 R, 98, 99 R, 176 M, 198 H, 208, 209, 217 R

[56] References Cited

U.S. PATENT DOCUMENTS

| | | | |
|---|---|---|---|
| 3,713,073 | 1/1973 | Narozny | 339/176 MF |
| 3,848,951 | 11/1974 | Michaels et al. | 339/198 H |
| 4,040,704 | 8/1977 | Huber | 339/99 R |
| 4,368,939 | 1/1983 | Foederer | 339/207 R |
| 4,425,018 | 1/1984 | Stenz | 339/198 H |
| 4,435,035 | 3/1984 | Berry et al. | 339/208 |

*Primary Examiner*—Gil Weidenfeld

*Assistant Examiner*—Thomas M. Kline

*Attorney, Agent, or Firm*—Perman & Green

[57] ABSTRACT

An electrical connector of the IDC type having three or more rows of contact members while still enabling sideways installation of mating conductors. The connector is comprised of at least two separate housings, a first housing comprising two rows of cavities disposed longitudinally and adjacent to each other. Each of the cavities is fitted with an electrical contact lug, one extremity of which is shaped for the fastening of a wire conductor, the other extremity being shaped as a contact member. At least one second housing contains at least one row of cavities fitted with contact lugs similar to those in the first housing. The first housing has a shelf member which extends transversely away from a front end. Each of the housings is provided with guiding and locking means to aid in joining, then locking, the housings together. Openings are provided in the shelf member and in the front end of the first housing to enable communication with the contact lugs from locations external of the connector. The resulting construction is a connector body having at least three rows of cavities with provision for correct alignment of the cavities and contact members therein when the housings are in the locked or mounted position.

8 Claims, 9 Drawing Figures

Figure 1A:
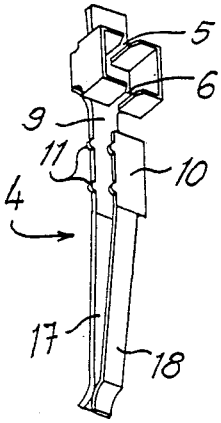
Figure 1A:
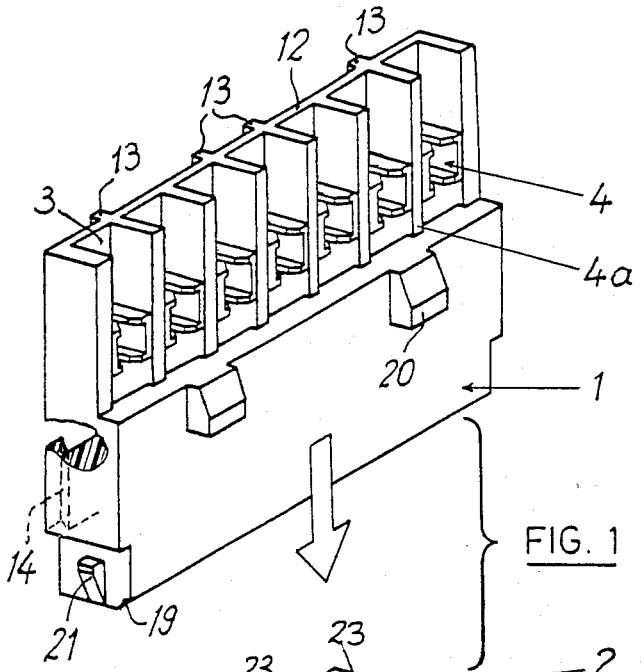

1
2
3
4
5
6
9
10
12
13
14
17
18
19
20
22
23
24
25
26
27
28
29
30
31

CONNECTOR FOR INDIVIDUAL CONDUCTORS

The invention relates to a connector for individual conductors and particularly to a connector provided with contacts of the type known under the designation "I.D.C." (Insulation Displacement Contact) in which the electrical connection for the wiring is obtained by sideways pressing of insulated or non-insulated wire into two superposed metal slots or wire locks, which form part of a contact of the connector and which are designed in such a way that they intersect the insulation of the wire due to which the metal conductor of the wire is clamped between the slots.

The invention also includes the working method for fixing the wiring in a similar connector.

The electrical connections of printed circuits in the telecommunications industry are principally realized nowadays by means of male and female connectors, which connect the auxiliary boards with the mother-board.

The electrical connections between the various mother-boards mutually are secured by individual conductors. To connect these conductors with the mother-board the "fixed one-time connections" are mounted on one side by "wire-wrapping" and the "connections suitable for coupling" on the other side by so-called female cable connectors.

The connections of the conductors with the female contacts of these cable connectors can be made by handsoldering or wire-wrapping.

The great disadvantage of soldering, however, and wire-wrapping, in comparison with a more recent technique, "IDC", is no doubt the installation cost.

For that reason cable connectors with IDC-terminals are preferred to solder- and wire-wrap versions. Single- and double-row IDC-cable connectors are already in use. A great number of applications, however, especially in telecommunication, requires a three-row version. The great problem, compared to single- and double-row connectors, is in this case the wiring of the centre contact row.

The solutions which are found on the market at present have a number of disadvantages, such as high installation costs; only conductors with special (non-standard) insulation diameters can be used. Starting from the principle of installing the conductors sideways and to make the centre row easily accessible for the pressing tool, by interpreting the three-row connector as a "bipartite" concept, a favorable solution is found for the abovementioned disadvantages.

The joining of these two parts to one whole so that a three-row connector is obtained, with conservation of all characteristics of a "one-part" concept, is rather simple if sufficient space is available to join both parts solidly together.

Such bipartite connectors have already been realized in which the housings of the double-row and single-row part are only provided at both ends with sprued-on fixing accessories.

The compound three-row connector thus obtained has the disadvantage, however, that the narrow one-row connector part is not connected over the entire length with the double-row part so that this part is subjected to distortions.

Such distortions are not allowed according to the requirements with regard to the tolerances of the distances between the common connector rows.

For systems built up with modular cable connectors there is furthermore not sufficient space available for the sprueing-on of such fixing accessories at the extremities of the connectors.

The purpose of the invention is the manufacture of a multiple-row cable connector consisting of two parts, which can be joined without making use of fixing accessories exceeding the normal dimensions and in which distortions between the contact rows are excluded.

The connector in accordance with the invention is composed of at least two separate housings, a first housing comprising two rows with cavities disposed longitudinally and adjacent to each other, each of these cavities being fitted with an electrical contact lug, one extremity of which is shaped for the fastening of a wire conductor, whereas the other extremity is shaped as a contact member, and at least one second housing which contains at least one row with cavities fitted with the same contacts, each of the housings being provided with guiding and locking means and means which are arranged over the length of the connector body and which, in combination with said guiding and locking means, secure the, at least, two housings together to obtain a composite connector body with at least three rows of cavities having a correct alignment of said cavities and contact members disposed therein when the housings are in locked position.

Figure 1:
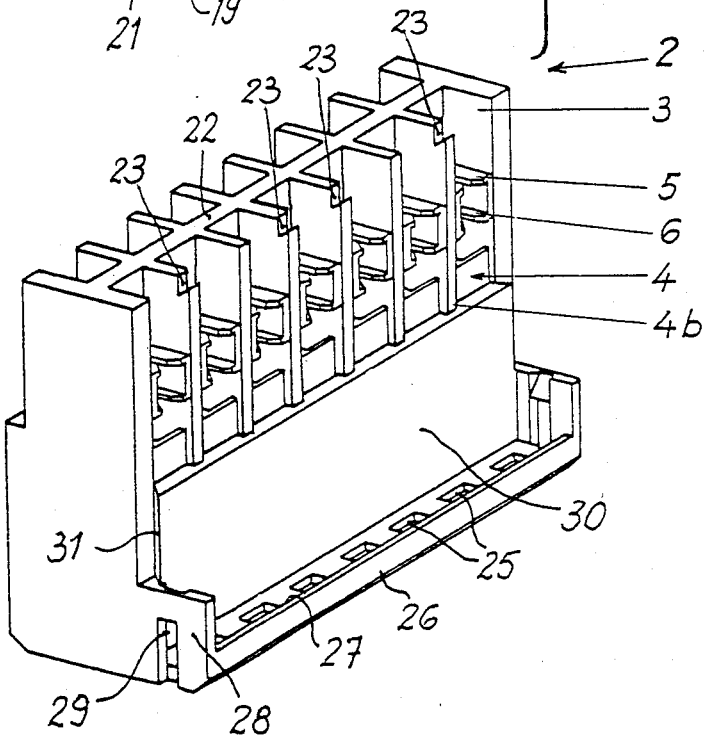

The claim will be elucidated by the following description of a construction method, which is referred to in annexe drawings, where:

FIG. 1: is a side-view in perspective of the two separate housings.

FIG. 1*a*: is a sketch in perspective of an electrical "IDC" contact.

Figures 2A, 2B:
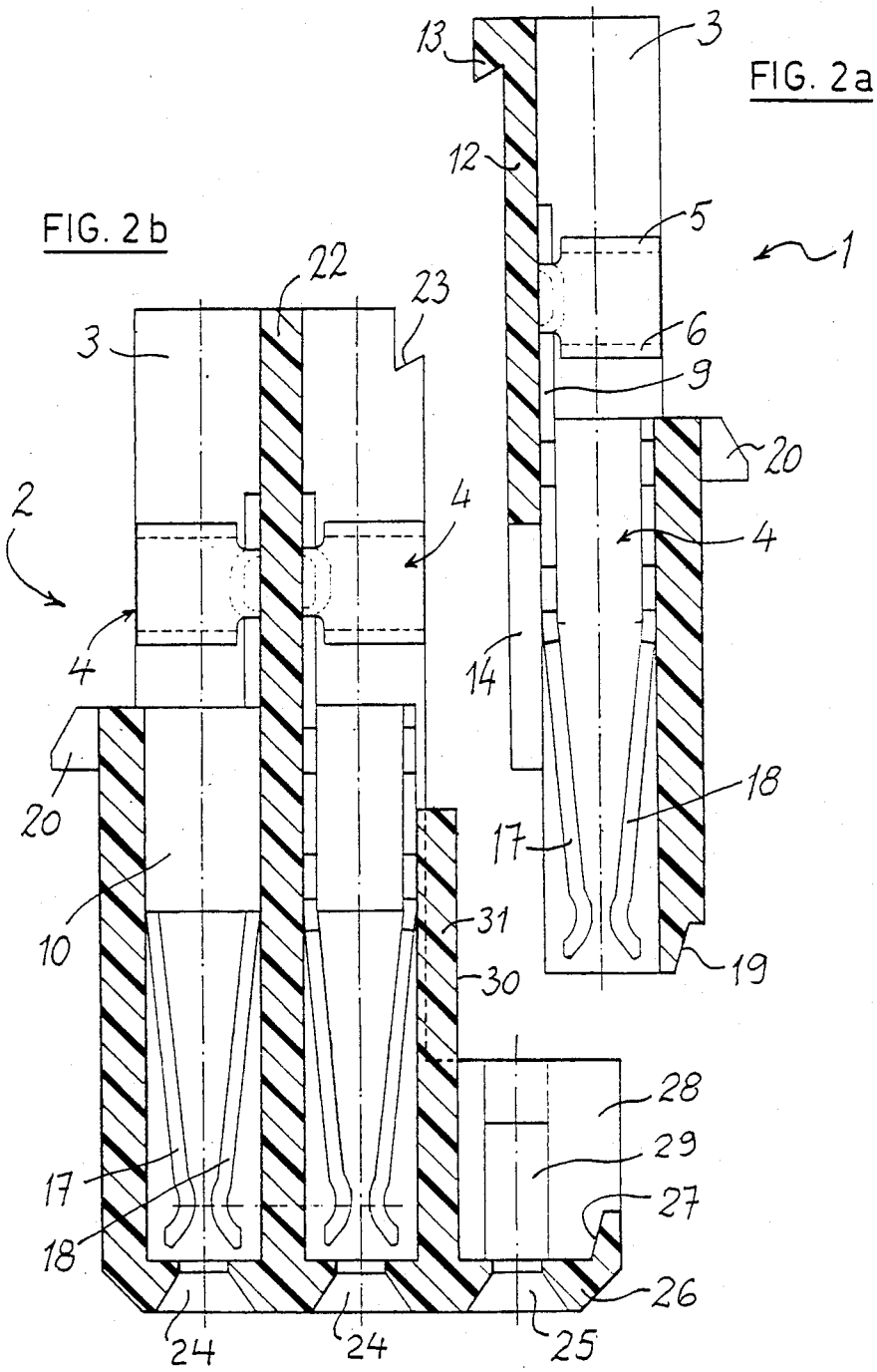

FIGS. 2*a* and 2*b* are cross-sections of the two separate housings.

Figure 3B:
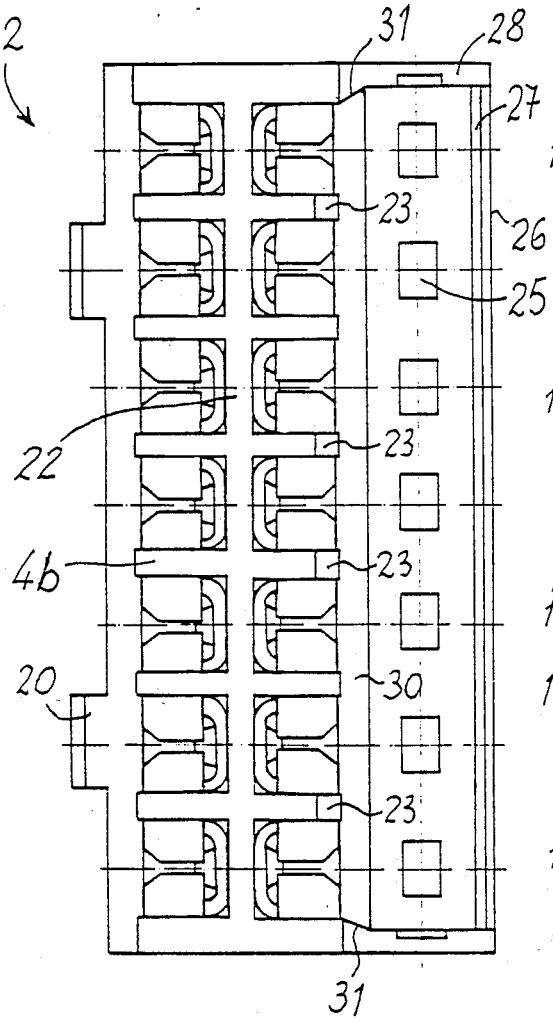
Figure 3A:
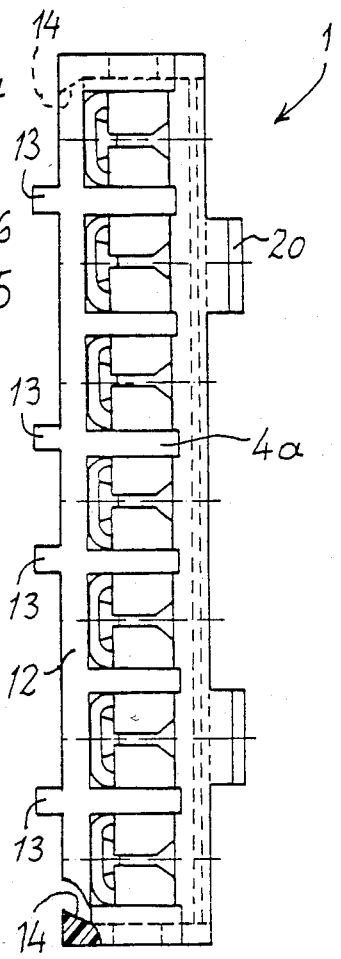

FIGS. 3*a* and 3*b* are plan views of the two separate housings.

Figure 4:
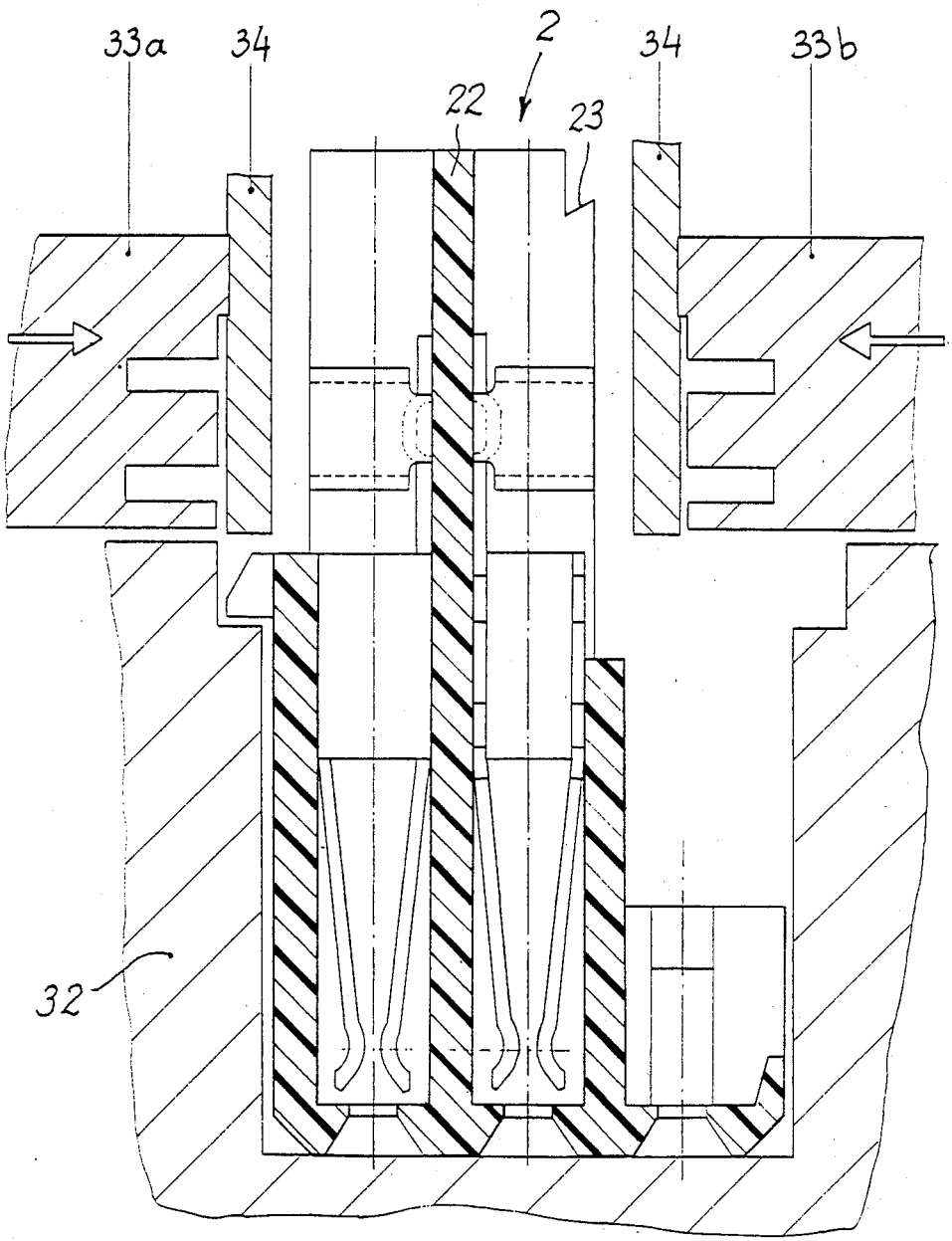
Figure 5:
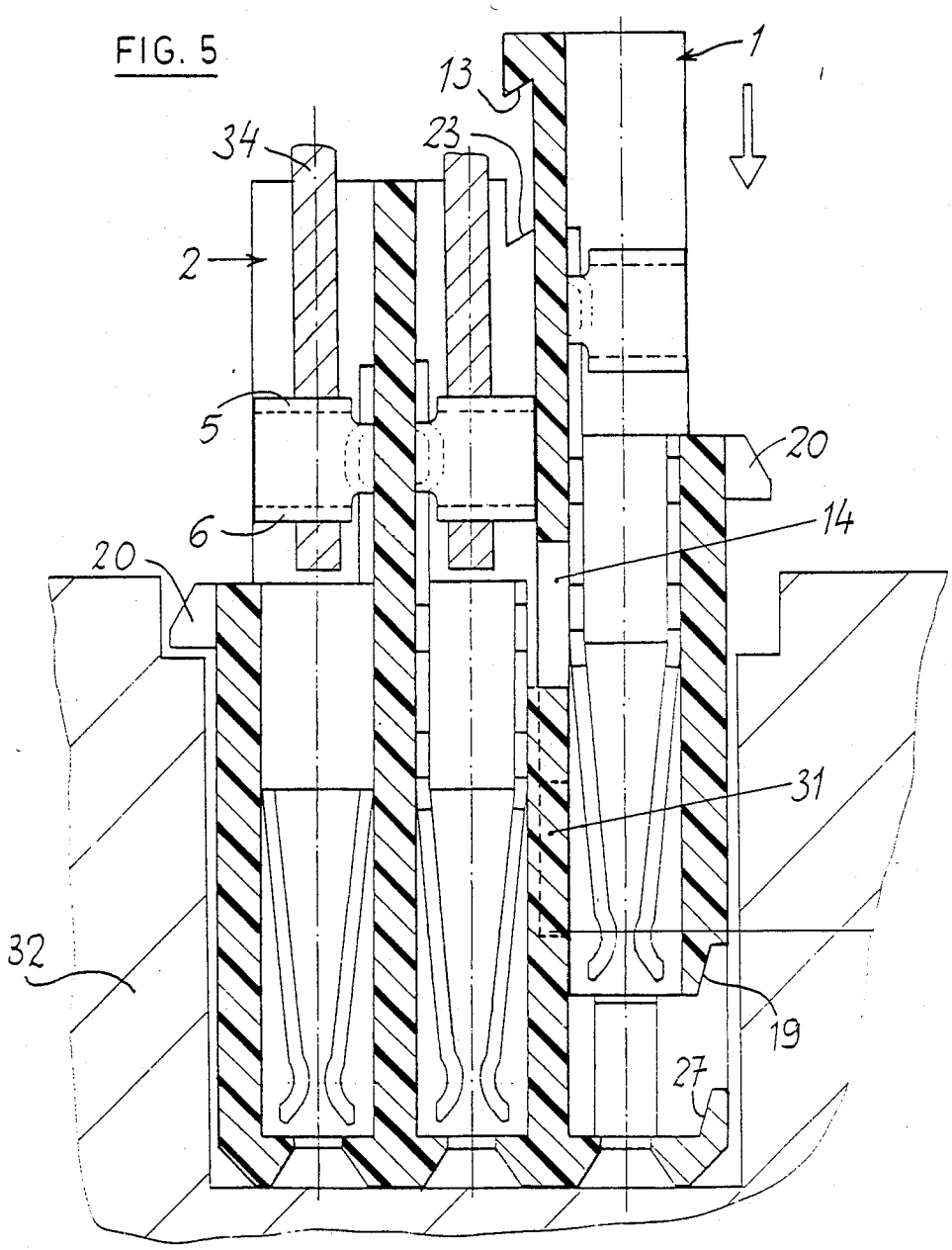
Figure 6:
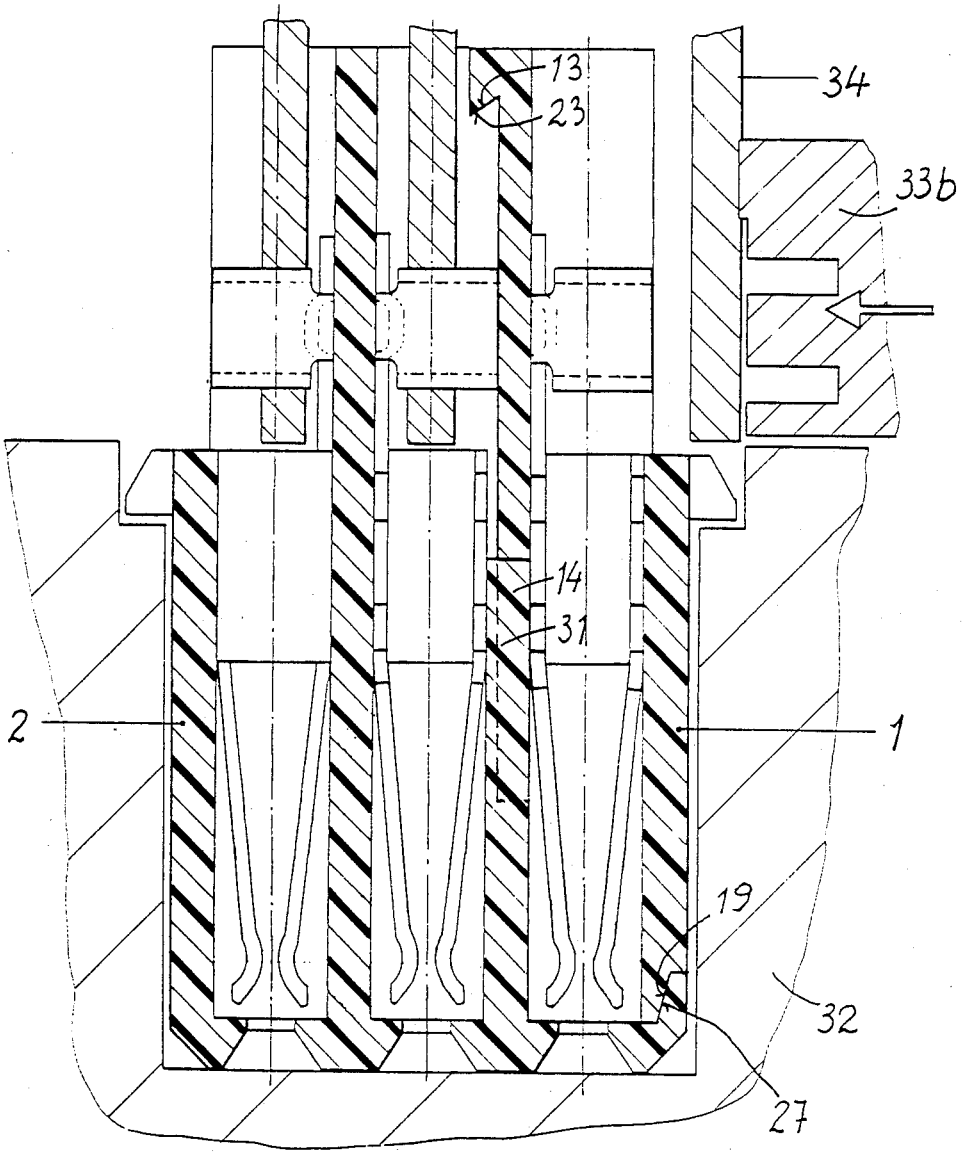

The FIGS. 4, 5 and 6 show the method for the wiring and assembling of the two separate housings.

On FIGS. 1, 2 and 3 two separate housings can be seen for a three-row connector in accordance with the invention, viz. a single-row housing 1 and a double-row housing 2.

Both housings contain a number of cavities 3, in which electrical contacts 4 are fixed. The contacts 4 are electrically insulated from each other by the walls 4*a* and 4*b*. The cavities 3 are open on the wiring side to receive the conductors and the press-in tool. The contacts 4 are each provided on this open side with two "V"-shaped slots, the so-called "IDC"-slots. These "V"-slots are destined to receive the connecting wires.

This contact consists of the "V"-shaped wire slots 5 and 6 and the "U"-shaped female contact 10, which secures the connection with the male pin (FIG. 1*a*).

These parts are interconnected by means of the mutual supporting strip 9. The projections 11 of the "U"-shaped part 10 of the female contact serve to fix the contact in the cavity.

FIG. 2*a* shows a cross-section of a cavity 3 of the single-row part 1.

The wall 12 contains a number of sprued-on hooks or a hook-shaped rib 13, situated on the top side of this wall 12.

Both ends of wall 12 are provided on the bottom side with inward slanting walls forming a dovetail 14.

FIG. 3*a* shows a plan view of dovetail 14.

Over the entire length and on the bottom side of housing 1 a trapezoidal groove 19 is provided.

The sideways projecting claws 20 situated at the level of the open side of the cavities 3 serve for fixing a cable cap after mounting of the wiring. At both ends the housing is equipped with sprued-on hooks 21 which serve for interlocking both housings 1 and 2.

FIGS. 2*b* and 3*b* show the double-row housing 2.

The cavities 3 of both rows are separated from each other by a common centre wall 22.

The side walls 4*b* of the cavities 3, which are situated along the side which receives the single-row part 1, have a triangular recess 23 on top. The position of these recesses 23 is identical to the position of the sprued-on hooks 13 of the single-row part 1. On the bottom side the double-row housing the cavities are provided with openings 24, rectangular-shaped and chamfered on the four sides to line up the male contacts during the connecting. The so-called mounting frames 25 of the single-row housing 1 have been sprued on the double-row housing 2 so that no tolerance problems occur during the alignment and on that account a proper alignment of the male contacts for the three rows is obtained. The sprued-on part 26, which includes the mounting frames 25 is provided over the entire length with a trapezium-shaped rib 27, which corresponds with the groove 19 at the bottom side of housing 1. The sprued-on part 26 also contains at both ends a wall 28, which is provided with a rectangular opening 29. Wall 30, situated on the side of sprued-on part 26 is provided at both ends with a slanting wall 31 to form a dovetail, which corresponds with dovetail 14 of housing 1.

FIGS. 4, 5 and 6 show the different steps to fix the wiring to the triple-row cable connector and to join them together.

The double-row part 2, mounted in holder 32, is fitted by means of the press-in tools 33*a* and 33*b* with wires 34 in the "V"-shaped contact slots 5 and 6.

After fixing the wires of all contacts in their cavities 3 the single-row part 1 is connected with the double-row part 2, without the double-row part having to be removed from holder 32.

The dovetail part 14 on both ends of housing 1 hooks into dovetail 31 of wall 30 of part 2. This constitutes the alignment of both parts 1 and 2 in the length of the connector and also serves as a guide, when both parts further slide into each other (FIG. 5).

During the pushing through of part 1 the hooks 21 on both ends will be received by the rectangular openings 29 of part 2. The sprued-on wall 28 of part 2 will slightly bend aside to let the hooks 21 penetrate completely in opening 29. When this step is terminated the further advancing of part 1 is prevented by the sprued-on part 26, as the bottom side of part 1 comes to rest on same. By means of the hooking effect of 21 into 29 is prevented that both parts can come apart.

During the step described above a hooking effect is also achieved by the hooks 13 of part 1, which engage in the triangular recesses 23 of part 2. This prevents the opening of both parts at the level of the wire connections. Furthermore the trapezoidal rib 27 of the double-row part 2 ensures an extra alignment of both parts 1 and 2 because rib 27 hooks into the trapezoidal groove 19 of part 1.

After the abovementioned step the single-row part 1 is combined with the double-row part 2 and the wiring of the single-row part 1 can then be carried out by means of the press-in tool 33*b* (FIG. 6).

The version of the invention described above is only presented as an example and does not prevent construction modifications and adaptations from being made without falling outside the limits of this protection on account of it.

So, for example, a four-row connector can be composed from two double-row housings, etc.

Still another embodiment of the present invention would be a composite connector body having five rows with contact cavities. Said connector body would present a first housing having two rows with cavities and a basic part extension (26) adapted with three rows of openings (25). On this extension portion three separate connector housings could be fixed, each of them having one single row of cavities and said guiding, locking and securing means.

I claim:

1. An electrical connector comprising:

a first housing defining two rows of vertically disposed cavities in side by side relationship, each of said rows having a closed side and open side, each of said cavities having an upper end and a lower end, apertures formed in said housing at said lower end of each said cavity, each of said cavities adapted to receive an electrical contact lug with the upper extent of each lug shaped with V-shaped slot means for engagement by a wire conductor and positionable adjacent said open side and with the lower extent of each lug positionable adjacent said lower end of each said cavity and shaped as a contact member, said open side having a plurality of openings therein, each of said openings being aligned with an associated cavity to expose the V-shaped slot means of a contact member therein;

a shelf member integral with said first housing extending outwardly from said lower end on said open side, said shelf member having a plurality of apertures therein;

at least one second housing defining at least one row of vertically disposed cavities in side by side relationship, said row having a closed side and an open side, each of said cavities of said second housing having an upper end and a lower end, apertures formed in said second housing at said lower end of each said cavity;

each of said cavities of said second housing adapted to receive one of the lugs with the upper extent of each lug with V-shaped slot means for engagement by a wire conductor and positionable adjacent said open side and with the lower extent of each lug positionable adjacent said lower end and shaped as a contact member, said second housing adapted to be engagably received by said first housing, said lower end of said second housing being contiguous with said shelf member;

whereby said apertures in said second housing are aligned with said apertures in said shelf member to thereby expose the lower extents of the lugs which may be contained within said cavities of said second housing.

2. An electrical connector as set forth in claim 1 including: interengaging guide means on said first housing and on said second housing, respectively, for supporting said second housing in a mounted position on said first housing such that said lower end of each said cavity of said second housing is continguous with said shelf member.

3. An electrical connector as set forth in claim 2 wherein each said cavity of said second housing is uniformly spaced with each said cavity of said first housing and substantially coextensive when said second housing is in the mounted position on said first housing.

4. An electrical connector as set forth in claim 2 wherein said interengaging guide means include: cooperating male dovetail surfaces extending longitudinally on said second housing slidably engageable with cooperating female dovetail surfaces extending longitudinally on said first housing.

5. An electrical connector as set forth in claim 4 wherein said first housing includes:

a pair of spaced apart end walls upstanding from said shelf member, said end walls having apertures therein; and wherein said second housing includes hook members engageable with said apertures in said end walls to thereby interlock said first housing and said second housing in the mounted position.

6. An electrical connector as set forth in claim 4:

wherein said shelf member terminates at an upstanding laterally extending rib located in a plane generally parallel to, and spaced from, said cavities in said first housing; and wherein said lower end of said second housing has a laterally extending groove engageable with said rib when said second housing is in the mounted position on said first housing.

7. An electrical connector comprising:

a first housing defining two rows of vertically disposed cavities in side by side relationship, each of said rows having a closed side and an open side, each of said cavities having an upper end and a lower end, aperture formed in said housing at said lower end of each said cavity;

an electrical contact lug received in each of said cavities with the upper extent of each said lug shaped with V-shaped slot means for engagement by a wire conductor and positionable adjacent said open side and with the lower extent of each said lug positionable adjacent said lower end of each said cavity and shaped as a contact member;

said open side having a plurality of openings therein, each of said openings being aligned with an associated cavity to expose the V-shaped slot means of said contact member therein;

a shelf member integral with said first housing extending outwardly from said lower end on said open side, said shelf member having a plurality of apertures therein;

at least one second housing defining at least one row of vertically disposed cavities in side by side relationship, said row having a closed side and an open side, each of said cavities of said second housing having an upper end and a lower end, apertures formed in said second housing at said lower end of each said cavity;

each of said cavities of said second housing adapted to receive one of said lugs with the upper extent of each said lug shaped with V-shaped slot means for engagement by a wire conductor and positionable adjacent said open side and with the lower extent of each said lug positionable adjacent said lower end and shaped as a contact member, said second housing adapted to be engagably received by said first housing, said lower extent of said second housing being contiguous with said shelf member;

whereby said apertures in said second housing are aligned with said apertures in said shelf member to thereby expose the lower ends of said lugs located within said cavities of said second housing.

8. An electrical connector as set forth in claim 7 wherein each of said electrical contact lugs includes:

a bifurcated contact portion at its extent adjacent said upper end of said cavities of said first housing defining laterally directed slots, said slots of said lugs in one of said rows opening laterally in one direction and the slots of said lugs in the other of said rows opening laterally in the opposite direction;

whereby before said second housing is mounted on said first housing, a tool is movable against all conductor wires aligned with said slots in said lugs received in each of said cavities of said first housing to in turn move the wires into said slots and thereby into conductive engagement with said bifurcated contact portions; and whereby, after said second housing is mounted on said first housing, a tool is movable against all conductor wires aligned with said slots in said lugs received in each of said cavities of said second housing to in turn move the wires into said slots and thereby into conductive engagement with said bifurcated contact portions.

* * * * *